US011649557B2

(12) United States Patent
Zhu et al.

(10) Patent No.: US 11,649,557 B2
(45) Date of Patent: May 16, 2023

(54) METHOD FOR FORMING HOLES, METAL PRODUCT, AND METAL COMPOSITE

(71) Applicant: Fulian Yuzhan Precision Technology Co., Ltd, Shenzhen (CN)

(72) Inventors: Wen-Cheng Zhu, Shenzhen (CN); Bo-Ling Xu, Shenzhen (CN); Xiao-Qing Fu, Shenzhen (CN); Xiao-Jian Wang, Shenzhen (CN); Jian-Hui Peng, Shenzhen (CN)

(73) Assignee: Fulian Yuzhan Precision Technology Co., Ltd, Shenzhen (CN)

( * ) Notice: Subject to any disclaimer, the term of this patent is extended or adjusted under 35 U.S.C. 154(b) by 0 days.

(21) Appl. No.: 17/528,908

(22) Filed: Nov. 17, 2021

(65) Prior Publication Data

US 2022/0205127 A1 Jun. 30, 2022

(30) Foreign Application Priority Data

Dec. 29, 2020 (CN) ..... 202011593469.2

(51) Int. Cl.

| | |
|---|---|
| ***C25F 3/04*** | (2006.01) |
| ***C25F 3/06*** | (2006.01) |
| ***C25D 11/04*** | (2006.01) |

(52) U.S. Cl.
CPC ..... *C25F 3/04* (2013.01); *C25D 11/04* (2013.01); *C25F 3/06* (2013.01)

(58) Field of Classification Search
CPC ..... H05K 5/00–069; C25D 11/04–246; C25F 3/04–06
See application file for complete search history.

(56) References Cited

U.S. PATENT DOCUMENTS

2021/0370635 A1* 12/2021 Hon ..... C25D 11/02

FOREIGN PATENT DOCUMENTS

CN 111619171 A * 9/2020 ..... B32B 15/012

* cited by examiner

*Primary Examiner* — Hosung Chung
(74) *Attorney, Agent, or Firm* — ScienBiziP, P.C.

(57) ABSTRACT

A method for forming holes to form holes in a surface of a metal part includes: putting the metal part into a first solution as an anode; applying a first voltage on the metal part to form the first holes in a surface of the metal part; and cleaning and drying the metal part with the first holes. The first solution comprises a first organic solvent, chloride, and a phosphoric acid compound. The disclosure also provides a metal product and a metal composite.

12 Claims, 11 Drawing Sheets

METHOD FOR FORMING HOLES, METAL PRODUCT, AND METAL COMPOSITE

CROSS-REFERENCE TO RELATED APPLICATIONS

This application claims all benefits accruing under 35 U.S.C. § 119 from Chinese Patent Application No. 202011593469.2 filed on Dec. 29, 2020, in the State Intellectual Property Office of China, the entire contents of which are incorporated herein by reference.

FIELD

The present disclosure relates to metal materials, and more particularly, the present disclosure relates to a method for forming holes, a metal product, a metal composite.

BACKGROUND

Portable consumer electronic products are being used more and more in people's lives. Consumers have higher and higher requirements for the appearance of electronic products and the performance of the housing. The existing housing molding process generally involves forming holes in a single metal piece, and then injecting plastic into the holes to form the housing. The holes in the metal piece formed by the traditional hole-forming method is not firmly combined with the material product.

SUMMARY

In view of the above situation, it is necessary to provide a method for forming holes to improve a bonding strength between a metal product and a material product.

According to some embodiments, a method for forming holes to form first holes in a surface of a metal part includes: putting the metal part into a first solution as an anode; applying a first voltage on the metal part to form the first holes in a surface of the metal part; and cleaning and drying the metal part with the first holes. The first solution includes a first organic solvent, chloride, and a phosphoric acid compound.

According to some embodiments, the first organic solvent is selected from a group consisting of ethylene glycol, propylene glycol, diethylene glycol, glycerol, and any combination thereof.

According to some embodiments, chloride is selected from a group consisting of sodium chloride, potassium chloride, copper chloride, ferric chloride, and any combination thereof.

According to some embodiments, the phosphoric acid compound is selected from a group consisting of phosphoric acid, dihydrogen phosphate, monohydrogen phosphate, phosphate, metaphosphate, and any combination thereof.

According to some embodiments, the first voltage is output by a gradual DC power supply, an increase rate of the first voltage is in a range of 1 V/s to 2 V/s, and a current density is in a range of 1 $A/dm^2$ to 10 $A/dm^2$; in the step of applying the first voltage on the metal part, a temperature of the first solution is in a range of 25° C. to 55° C., and a time of applying the first voltage is in a range of 10 min to 25 min.

According to some embodiments, before putting the metal part into the first solution, the method for forming holes further includes: putting the metal part into a second solution as an anode; and applying a second voltage on the metal part to form second holes in a surface of the metal part. The second solution includes a second organic solvent and a substance capable of dissociating $Cl^-$.

According to some embodiments, the substance capable of dissociating $Cl^-$ includes a compound containing crystallization water.

According to some embodiments, the substance capable of dissociating $Cl^-$ is selected from a group consisting of NaCl, KCl, $FeCl_3 \cdot 6H_2O$, $FeCl_3$, $CuCl_2 \cdot 12H_2O$, $CuCl_2$, and any combination thereof.

According to some embodiments, the second solution further includes a substance capable of dissociating at least one $Fe^{3+}$ and $Cu^{2+}$.

According to some embodiments, the substance capable of dissociating $Fe^{3+}$ or $Cu^{2+}$ includes a compound containing crystallization water.

According to some embodiments, the substance capable of dissociating $Fe^{3+}$ is selected from a group consisting of $FeCl_3 \cdot 6H_2O$, $FeCl_3$, and any combination thereof, and the substance capable of dissociating $Cu^{2+}$ is selected from a group consisting of $CuCl_2 \cdot 12H_2O$, $CuCl_2$, and any combination thereof.

According to some embodiments, the second voltage is output by DC power supply, the second voltage is in a range of 60V to 100V, and a current density is in a range of 1 $A/dm^2$ to 3 $A/dm^2$; in the step of applying the second voltage on the metal part, a temperature of the second solution is in a range of 50° C. to 70° C., and a time of applying the second voltage is in a range of 5 min to 20 min.

According to some embodiments, after putting the metal part into the first solution, the method for forming holes further includes: putting the metal part with the first holes into an electrolyte as an anode; and applying a third voltage on the metal part to form third holes in the metal part. The metal part is made of a material selected from a group consisting of aluminum, aluminum alloy, a composite material of aluminum alloy and stainless steel, and any combination thereof, the third holes are located in a portion of the metal part containing aluminum or aluminum alloy.

According to some embodiments, the metal part is made of a material selected from a group consisting of aluminum, aluminum alloy, stainless steel, and any combination thereof.

According to some embodiments, a metal product a metal substrate and holes in a surface of the metal substrate. The metal substrate is made of a material selected from a group consisting of aluminum, aluminum alloy, stainless steel, and any combination thereof, and the holes occupy 20% to 90% of an area of the surface of the metal substrate.

According to some embodiments, the metal substrate comprises an aluminum alloy portion and a stainless steel portion, the holes are located in a surface of the aluminum alloy portion and a surface of the stainless steel portion. A diameter of an inner cavity of each of at least one of the holes in the surface of the stainless steel portion is larger than a diameter of an opening of the corresponding hole.

According to some embodiments, a diameter of each of the holes in the aluminum alloy portion is in a range of 60 μm to 150 μm, a depth of each of the holes in the aluminum alloy portion is in a range of 80 μm to 100 μm, and the holes in the aluminum alloy portion occupy 60% to 90% of a portion of the area of the surface of the metal substrate corresponding to the aluminum alloy portion.

According to some embodiments, oxide holes are formed in an inner surface defining the inner cavity, and the oxide holes are nano-sized holes.

According to some embodiments, a metal composite includes the above metal product and a material product formed in the holes of the metal product.

According to some embodiments, the material product made of a material selected form a group consisting of metal, polymer, ceramic, glass, and any combination thereof.

In the method for forming holes, by adding corrosive ions into the first solution mainly composed of at least one organic solvent, the organic solvent can increase the energy required for the migration of corrosive ions ($Cl^-$) and reduce the diffusion rate of the corrosive ions (such as $Cl^-$), so that the corrosive ions (such as $Cl^-$) will not be unevenly distributed due to the influence of reaction activity, but can evenly bind effective ions that corrode to form holes on the surface of the metal part. Based on the small radius and the strong penetrating ability of $Cl^-$, $Cl^-$ can be preferentially adsorbed on the oxides to squeeze out oxygen atoms of the oxides and combine with cations of the oxides to form soluble chloride, thereby forming the first holes in the surface of the metal part. In addition, $PO_4^{3-}$ can react with the metal to form the aluminum phosphate film, thereby forming the first holes in a shape of coral.

BRIEF DESCRIPTION OF THE DRAWINGS

Implementations of the present disclosure will now be described, by way of example only, with reference to the attached figures.

DETAILED DESCRIPTION

Figure 1:
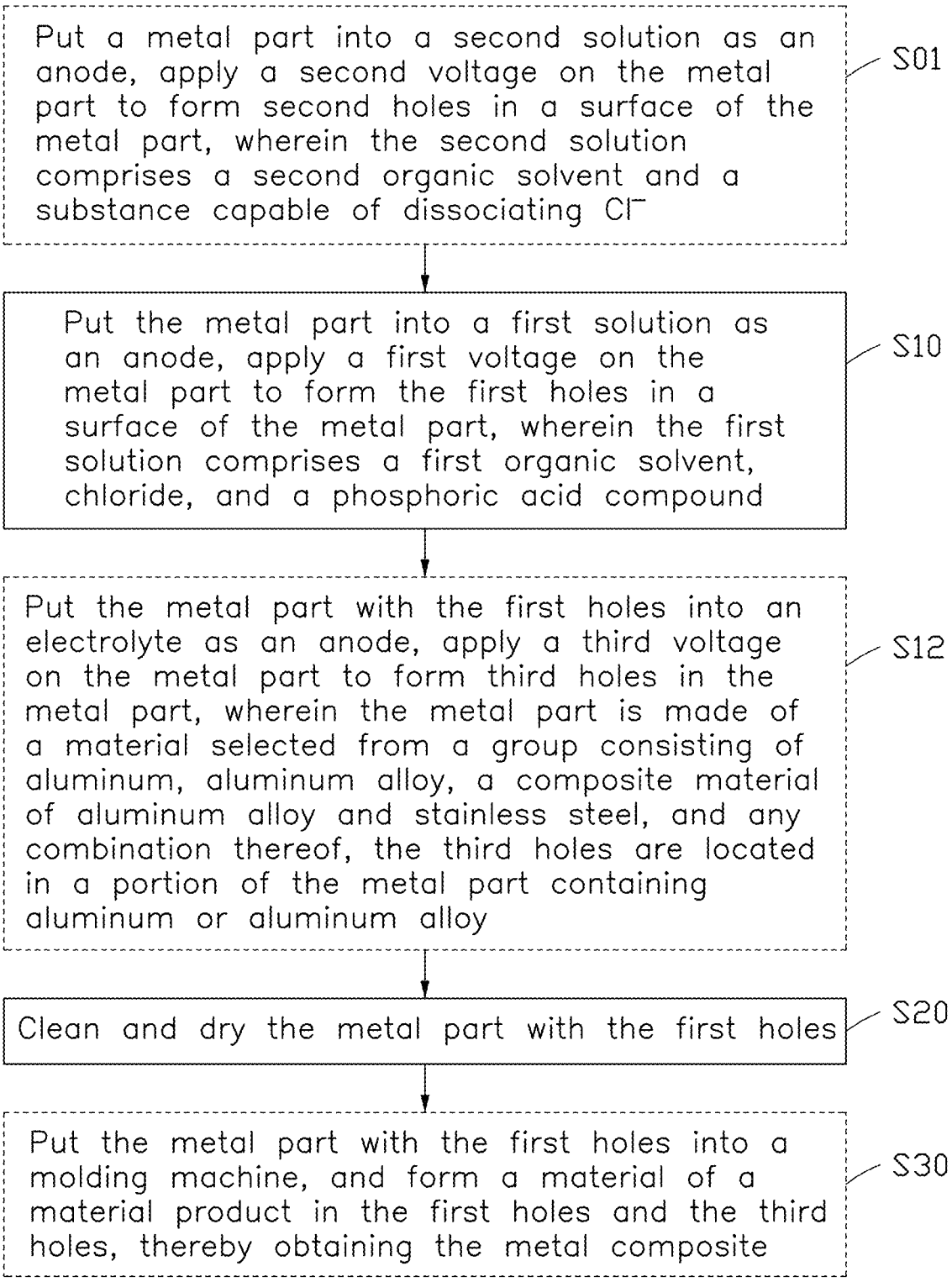
FIG. 1 is a flowchart of a method for forming holes, in accordance with some embodiments of the present disclosure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale, and the proportions of certain parts may be exaggerated to better illustrate details and features of the present disclosure.

The term "comprising," when utilized, means "including, but not necessarily limited to"; it specifically indicates open-ended inclusion or membership in the so-described combination, group, series, and the like.

According to some embodiments, a method for forming holes is provided to form first holes 30 in a surface of a metal part 100 (shown in FIGS. 1-4). In some embodiments illustrated in FIG. 1, a flowchart of a method for forming holes includes following steps.

Figure 2:
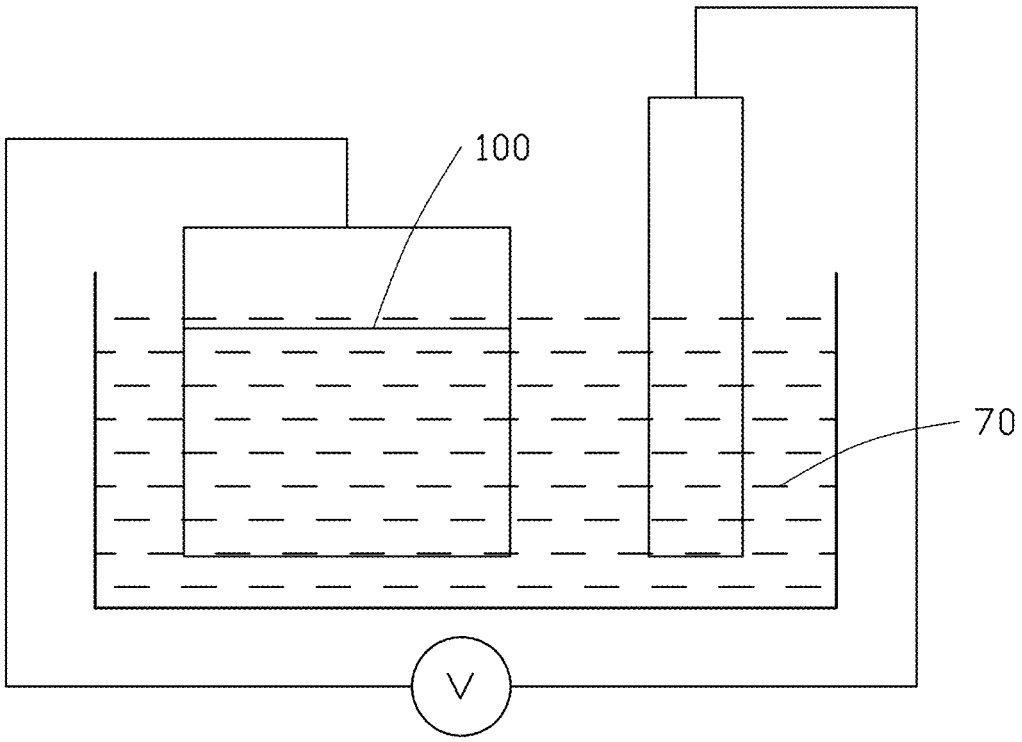
FIG. 2 is a diagram of applying a second voltage on a metal part as an anode, in accordance with some embodiments of the present disclosure.
Figure 3:
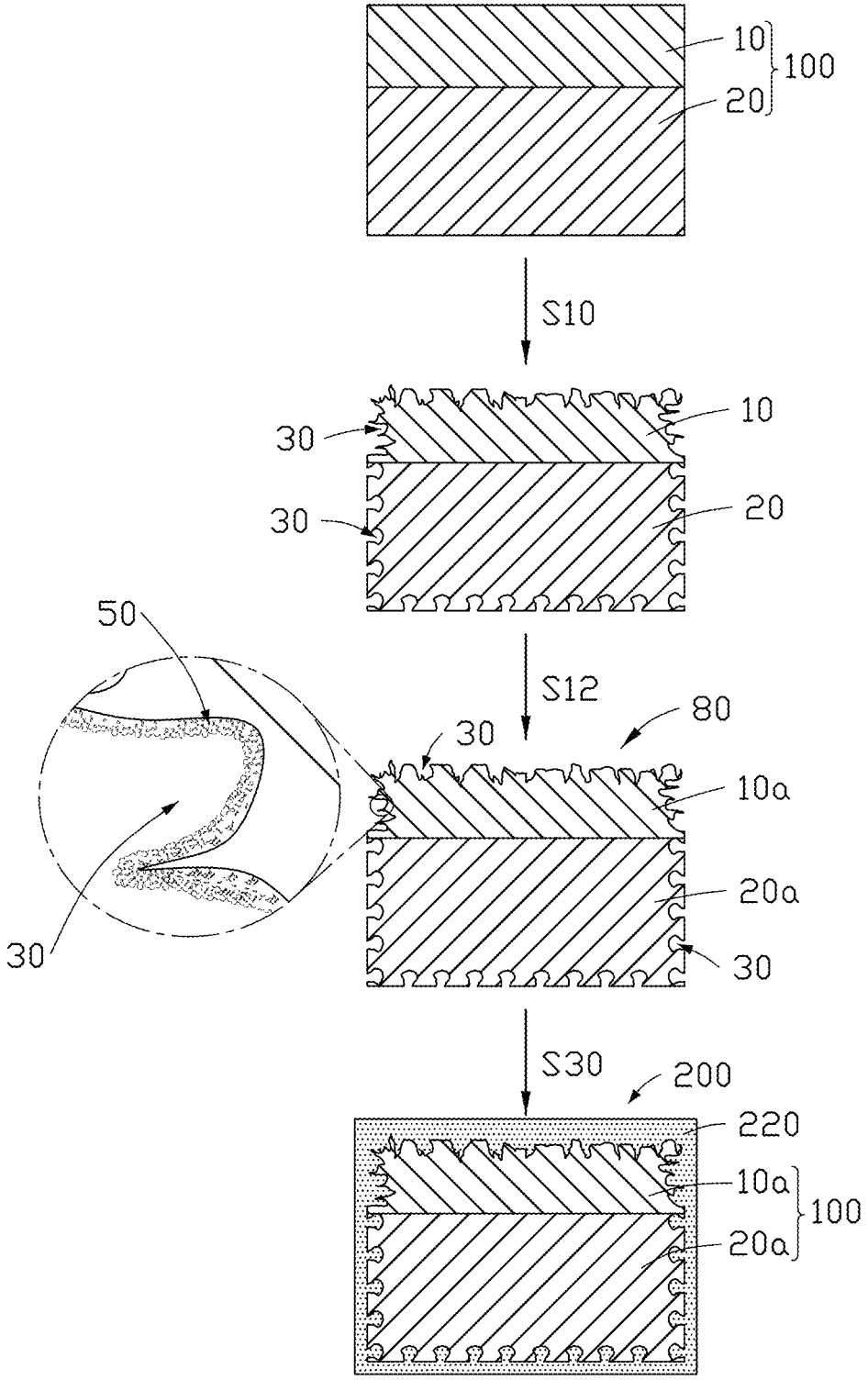
FIG. 3 is a simplified cross-sectional side view of first holes and third holes sequentially formed on a surface of a metal part, in accordance with some embodiments of the present disclosure.

Step S10, in some embodiments illustrated in FIGS. 2 and 3, putting a metal part 100 into a first solution 70 as an anode, then applying a first voltage on the metal part 100 to form first holes 30 in a surface of the metal part 100. The first solution 70 includes a first organic solvent, chloride, and a phosphoric acid compound.

The first solution 70 further includes water. In the first solution 70, the chloride can dissociate chloride ions ($Cl^-$) in the water, and the phosphoric acid compound can dissociate phosphate ions ($PO_4^{3-}$) in the water.

The first organic solvent may be alcohol that can be miscible with water. The alcohol may be selected from a group consisting of ethylene glycol, propylene glycol, diethylene glycol, glycerol, and any combination thereof. The first organic solvent and water are mutually soluble, so that hydrolyzed ions are uniformly dispersed in the first organic solvent and uniformly loaded on the surface of the metal part 100 during applying the first voltage.

The metal part 100 may be made of a material selected from a group consisting of aluminum, aluminum alloy, a composite material of aluminum alloy and stainless steel, and any combination thereof.

According to some embodiments, the metal part 100 includes an aluminum alloy portion 10. During applying the first voltage, a surface of the aluminum alloy portion 10 is oxidized to form oxides. Based on a small radius and a strong penetrating ability of $Cl^-$, $Cl^-$ can be preferentially adsorbed on the oxides to squeeze out oxygen atoms of the oxides and combine with cations of the oxides to form soluble chloride, thereby forming first holes 30 in a shape of coral in the surface of the aluminum alloy portion 10. That is, the surface of the aluminum alloy portion 10 is uneven due to the holes and a protrusion between any two adjacent holes. Further, an inner wall defining each of the first holes 30 may include at least one protrusion. In addition, $PO_4^{3-}$ can react with the aluminum of the aluminum alloy portion 10 to form an aluminum phosphate film on the surface of the aluminum alloy portion 10, and the reaction formula is $Al^{3+}+PO_3^{3+}=AlPO_4$, thereby preventing surface of the aluminum alloy portion 10 from excessively corroding.

According to some embodiments, the metal part 100 includes the aluminum alloy portion 10 and a stainless steel portion 20. During applying the first voltage, a surface of the aluminum alloy portion 10 and a surface of the stainless steel portion 20 are oxidized to form oxides. Based on the small radius and the strong penetrating ability of Cl, Cl can be preferentially adsorbed on the oxides to squeeze out oxygen atoms of the oxides and combine with cations of the oxides to form soluble chloride, thereby forming first holes 30 in the surface of the aluminum alloy portion 10 and the stainless steel portion 20. In addition, $PO_4^{3-}$ can react with the aluminum of the aluminum alloy portion 10 to form an aluminum phosphate film on the surface of the aluminum alloy portion 10, and the reaction formula is $Al^{3+}+PO_4^{3+}=AlPO_4$, thereby forming holes in a shape of coral in the surface of the aluminum alloy portion 10. That is, the first holes 30 are formed in the surface of the aluminum alloy portion 10 and the surface of the stainless steel portion 20, the first holes 30 in the surface of the aluminum alloy portion 10 are coral-shaped, and the first holes 30 in the surface of the stainless steel portion 20 are pitting-shaped.

The water may be separately added to the first solution 70, or may be generated by a compound containing crystallization water added in the first solution 70. The water can be used to dissociate chloride to form Cl, and to dissociate the phosphoric acid compound to $PO_4^{3-}$.

Chloride may be selected from a group consisting of sodium chloride, potassium chloride, copper chloride, ferric chloride, and any combination thereof.

According to some embodiments, Chloride is ferric chloride, and ferric chloride can not only dissociate $Cl^-$, but also dissociate iron ions ($Fe^{3+}$). $Fe^{3+}$ can interact with iron (Fe) of the stainless steel portion 20 to further form pitted first holes 30.

The phosphoric acid compound may be selected from a group consisting of phosphoric acid, dihydrogen phosphate, monohydrogen phosphate, phosphate, metaphosphate, and any combination thereof.

The first voltage is output by DC power supply to make the ions in the first solution 70 migrate in an orderly manner. A current density may be in a range of 1 $A/dm^2$ to 10 $A/dm^2$. According to some embodiments, the current density may be 1.6 $A/dm^2$, 3.2 $A/dm^2$, 5.6 $A/dm^2$, or 7.8 $A/dm^2$.

The first voltage may also be output by a gradual DC power supply. An increase rate of the first voltage may be in a range of 1 V/s to 2 V/s. According to some embodiments, the increase rate of the first voltage may be 1.2 V/s, 1.4 V/s, 1.6 V/s, or 1.8 V/s. The gradual DC power supply can prevent sudden excessive voltage from causing a concentrated discharge of electric charges and forming large holes that do not meet requirements in the surface of the metal part 100.

In the step of applying the first voltage on the metal part 100, a temperature of the first solution 70 may be in a range of 25° C. to 55° C., and a time of applying the first voltage may be in a range of 10 min to 25 min.

In step S20, cleaning and drying the metal part 100 with the first holes 30 to obtain a metal product 80.

The ions and the first organic solvent on the surface of the metal part 100 are cleaned, and then the metal part 100 is dried, thereby obtaining the clean metal product 80 with the first holes 30.

According to some embodiments, before the step S10, the method may further include a step S01.

Figure 4:
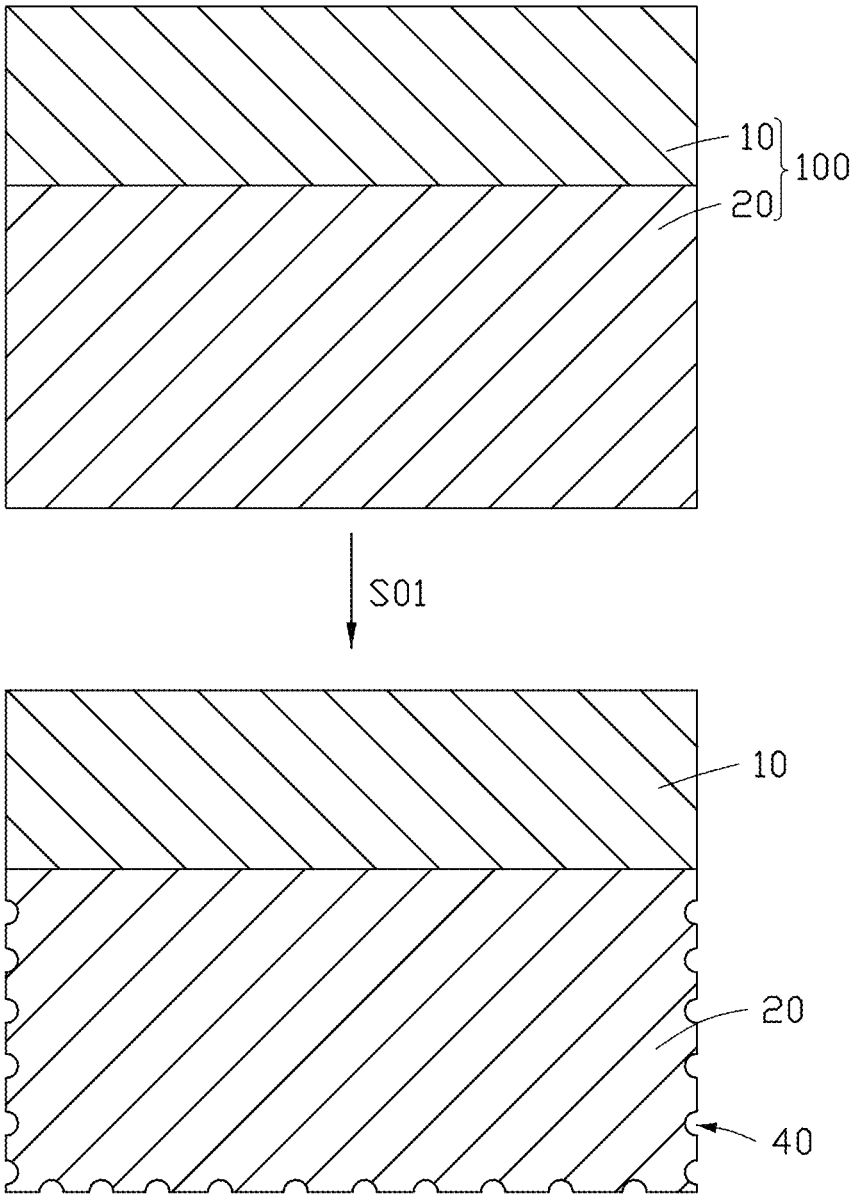
FIG. 4 is a simplified cross-sectional side view of second holes formed on on a surface of a metal part, in accordance with some embodiments of the present disclosure.

The step S01, in some embodiments illustrated in FIG. 4, putting a metal part 100 into a second solution as an anode, then applying a second voltage on the metal part 100 to form second holes 40 in a surface of the metal part 100. The second solution includes a second organic solvent and a substance that can dissociate Cl.

During applying the second voltage, the second organic solvent can increase an energy required for a migration of corrosive ions ($Cl^-$) and reduce a diffusion rate of the corrosive ions (such as $Cl^-$), so that the corrosive ions (such as $Cl^-$) will not be unevenly distributed due to the influence of reaction activity, but can evenly bind effective ions that corrode to form holes on the surface of the metal part 100, so as to avoid a formation of galvanic cells in an electric field due to a potential difference between the aluminum alloy portion 10 and the stainless steel portion 20, prevent the corrosive ions (such as $Cl^-$) from being concentrated on the surface of the aluminum alloy portion 10 serving as the anode to react with the aluminum alloy portion 10, and avoid a phenomenon that the stainless steel portion 20 is not etched to form holes by the corrosive ions (such as $Cl^-$). The surface of the metal part 100 is weakly corroded by electrochemical traction. Due to the difference in material between the aluminum alloy portion 10 and the stainless steel portion 20, an oxide film (alumina) is formed on the surface of the aluminum alloy portion 10 to protect the aluminum alloy portion 10 and avoid excessive corrosion of the surface aluminum alloy portion 10 by the corrosive ions. Therefore, it is possible to form high-density second holes 40 in the surface of the stainless steel portion 20 while protecting the aluminum alloy portion 10.

The second solution further includes water. The water may be separately added to the second solution, or may be generated by a compound containing crystallization water added in the second solution. The water can be used for dissociation to form $Cl^-$.

A mass fraction of the water in the second solution is in a range of 7% to 63%. A content of the water in the second solution should not be too much. On the one hand, if the water is excessive (more than 63%), a content of the second organic solvent will be reduced, which will not play a role of restraining the corrosive ions. On the other hand, the water in the second solution is not excessive, which can prevent the corrosive ions from migrating too fast in the excess water and quickly corroding the surface of the aluminum alloy portion 10. The content of the water in the second solution should not be too low (less than 7%), otherwise a migration rate of the corrosive ions is too slow, resulting in a low reaction efficiency and increasing time cost and energy cost. According to some embodiments, part of the water may also be provided by the crystallization water contained in the compound.

The substance capable of dissociating $Cl^-$ may be selected from a group consisting of NaCl, KCl, $FeCl_3 \cdot 6H_2O$, $FeCl_3$, $CuCl_2 \cdot 12H_2O$, $CuCl_2$, and any combination thereof.

According to some embodiments, the second solution may further include a substance capable of dissociating at least one $Fe^{3+}$ and $Cu^{2+}$.

The substance capable of dissociating $Fe^{3+}$, $Cu^{2+}$, or $Cl^-$ includes a compound containing crystallization water.

The substance capable of dissociating $Fe^{3+}$ may be selected from a group consisting of $FeCl_3 \cdot 6H_2O$, $FeCl_3$, and any combination thereof. The substance capable of dissociating $Cu^{2+}$ may be selected from a group consisting of $CuCl_2 \cdot 12H_2O$, $CuCl_2$, and any combination thereof. The substance capable of dissociating $Cl^-$ may be selected from a group consisting of NaCl, KCl, $FeCl_3 \cdot 6H_2O$, $FeCl_3$, $CuCl_2 \cdot 12H_2O$, $CuCl_2$, and any combination thereof.

When the second solution contains at least one of $Fe^{3+}$ and $Cu^{2+}$, a potential of $Fe^{3+}$ and a potential of $Cu^{2+}$ are both higher than a potential of elemental iron (Fe), and both can have a substitution reaction with the iron in the stainless steel portion 20, which is beneficial to etching the stainless steel portion 20 to further form the second holes 40 having larger diameters. A potential difference (shorted as PD) between $Cu^{2+}$ and Fe is greater than a PD between $Fe^{3+}$ and Fe. Therefore, the second solution containing $Cu^{2+}$ is more conducive to forming the second holes 40 having larger diameters and larger depths than second solution containing $Fe^{3+}$.

The second organic solvent may be alcohol that can be miscible with water. The alcohol may be selected from a group consisting of ethylene glycol, propylene glycol, diethylene glycol, glycerol, and any combination thereof. The second organic solvent and water are mutually soluble, so that hydrolyzed ions are uniformly dispersed in the second organic solvent and the corrosive ions are uniformly loaded on the surface of the metal part 100 during applying the second voltage.

The second voltage is output by DC power supply to make the ions in the second solution migrate in an orderly manner. The second voltage may be in a range of 60V to 100V. A current density may be in a range of 1 $A/dm^2$ to 3 $A/dm^2$. According to some embodiments, the second voltage may be 65V, 76V, 88V, or 95V, and the current density may be 1.5 $A/dm^2$, 1.9 $A/dm^2$, 2.3 $A/dm^2$, or 2.8 $A/dm^2$.

In the step of applying the second voltage on the metal part 100, a temperature of the second solution may be in a range of 50° C. to 70° C. According to some embodiments, the temperature of the second solution may be 55° C., 59° C., 63° C., or 68° C. If the temperature of the second solution is too low, a density of the second holes formed in the stainless steel portion 20 will be low. If the temperature of the second solution is too high, energy is provided for ion migration, thereby corroding the aluminum alloy portion 10.

A time of applying the second voltage may be in a range of 5 min to 20 min. According to some embodiments, the time of applying the second voltage may be 7 min, 9 min, 13 min, or 17 min. The time of applying the second voltage can be adjusted according to factors such as the diameter, the depth, and the density of the second holes 40 required to be formed.

According to some embodiments, before forming the second holes 40 in the surface of the metal part 100, the method may further include a step of applying a surface treatment of the metal part 100 to remove impurities, oil stains, oxide layers, etc. on the surface of the metal part 100. The surface treatment may includes oil removal treatment and black film peeling treatment.

According to some embodiments, after the step S10 and before the step 20, the method may further include a step S12.

The step S12, in some embodiments illustrated in FIG. 3, putting the metal part 100 with the first holes 30 into an electrolyte as an anode, then applying a third voltage on the metal part 100 to form third holes 50. The metal part 100 may be made of a material selected from a group consisting of aluminum, aluminum alloy, a composite material of aluminum alloy and stainless steel, and any combination thereof. The third holes 50 are located in a portion of the metal part 100 including aluminum or aluminum alloy.

According to some embodiments, the metal part 100 applied in the step 12 may further include second holes 40.

The step S12 may be an anodic oxidation process. Water is mainly used as a solvent in the electrolyte to from an anodic oxidation film with holes on the aluminum alloy portion 10.

In some embodiments illustrated in FIG. 3, a metal product 80 formed by the above method for forming holes is provided. The metal product 80 includes a metal substrate and holes located in a surface of the metal substrate The metal substrate may be made of a material selected from a group consisting of aluminum, aluminum alloy, stainless steel, and any combination thereof. The holes may occupy 20% to 90% of an area of the surface of the metal substrate. The holes are the first holes 30 described above.

According to some embodiments, the metal substrate is made of a material composed of an aluminum alloy portion and a stainless steel portion, that is, the metal substrate includes an aluminum alloy portion 10*a* and a stainless steel portion 20*a*. The holes are located in a surface of the aluminum alloy portion 10*a* and a surface of the stainless steel portion 20*a*. The holes in a surface of the aluminum alloy portion 10*a* are coral-shaped. A diameter of an inner cavity of each of at least one of the holes in the surface of the stainless steel portion 20*a* is larger than a diameter of an opening of the corresponding hole, that is, the at least one of the holes located in the stainless steel portion is barbed-shaped.

A diameter of each of the holes in the aluminum alloy portion 10*a* is in a range of 60 μm to 150 μm. A depth of each of the holes in the aluminum alloy portion 10*a* is in a range of 80 μm to 100 μm. The holes in the aluminum alloy portion 10*a* occupy 60% to 90% of a portion of the area of the surface of the metal substrate corresponding to the aluminum alloy portion 10*a*.

A diameter of each of the holes in the stainless steel portion 20*a* is in a range of 60 μm to 120 μm. A depth of each of the holes in the stainless steel portion 20*a* is in a range of 50 μm to 100 μm. The holes in the stainless steel portion 20*a* occupy 20% to 55% of a portion of the area of the surface of the metal substrate corresponding to the stainless steel portion 20*a*.

The metal product 80 may further include an oxide film including oxide holes on the aluminum alloy portion 10*a*. The oxide holes in the oxide film are the third holes 50 described above. A diameter of each of the oxide holes included in the oxide film may be in a range of 1 nm to 900 nm. A shape of the each of the oxide holes included in the oxide film may be roughly cylindrical.

According to some embodiments, the metal substrate is made of the material selected from a group consisting of aluminum, aluminum alloy, and any combination thereof. An inner cavity of each of the holes is coral-shaped. That is, the surface of the metal substrate with the holes is uneven due to the holes and a protrusion between any two adjacent holes. Further, an inner surface defining the inner cavity may include at least one protrusion.

According to some embodiments, the oxide holes are formed in the inner surface defining the inner cavity. The oxide holes are nano-sized holes.

In some embodiments illustrated in FIG. 3, a metal composite 200 is provided. The metal composite 200 includes the metal product 80 and a material product 220. The material product 220 is formed in the holes to be combined with the metal product 80, thereby enhancing a bonding strength between the material product 220 and the metal product 80.

The material product 220 may be made of a material selected form a group consisting of metal, polymer, ceramic, glass, and any combination thereof. It should be noted that the polymer includes plastics or resins commonly used.

According to some embodiments, the metal product 80 includes the first holes 30, the material product 220 is formed in the first holes 30 to enhance the bonding strength between the material product 220 and the metal product 80.

According to some embodiments, the metal product 80 may further include the third holes 50, that is, the oxide holes. The material product 220 may be further formed in the third holes 50 to further enhance the bonding strength between the material product 220 and the metal product 80.

According to some embodiments, after the step S20, the method may further include a step S30.

The step 30, in some embodiments illustrated in FIG. 3, putting the metal part 100 with the first holes 30 into a molding machine (not shown), and forming the material of the material product 220 in the first holes 30 and the third holes 50, thereby obtaining the metal composite 200.

According to some embodiments, the molding machine may be an injection molding machine for injecting polymer into the first holes 30 and the third holes 50 to form the metal composite 200.

Some specific examples and comparative examples are listed below to better illustrate this application. It should be noted that the metal parts 100 used in Examples 1-1 to 5-4 and Comparative Example 2-1 are workpieces after a surface treatment, and respectively include the aluminum alloy portion made of aluminum alloy 6013 and the stainless steel portion made of stainless steel 316. The metal parts 100 used in Examples 6-1 to 9-3 and Comparative Examples 6-1 to 8-1 are workpieces are all the workpieces processed in Example 2-1.

The surface treatment includes: first placing the metal part 100 in an aqueous solution containing a degreasing agent (BONDERITE C-AK 1523R) having a mass fraction of 35% at a temperature of 55° C. to ultrasonic cleaning for 3 min; then putting the metal part 100 in nitric acid having a mass fraction of 35% for 1 min.

The metal product 80 obtained after the metal part 100 undergoes a method for forming holes is tested for holes forming condition through an optical microscope.

Examples 1-1 to 1-4

The metal part 100 after the surface treatment was putted into a first solution 70. The first solution 70 included 40 wt % propylene glycol, 5 wt % ethylene glycol, 10 wt % phosphoric acid, 5 wt % sodium chloride, and 45 wt % water. In Examples 1-1 to 1-4, rection temperatures of Examples 1-1 to 1-4 were controlled to be 20° C., 30° C., 40° C., and 50° C., respectively. Then, the metal part 100 was used as an anode, a first voltage was applied on the metal part 100 for 15 min to form first holes 30. A current density was controlled to be 3 A/dm$^2$. Finally, the metal part 100 with the first holes 30 was taken out to wash with water, and dried at a temperature of 80° C. for 20 min.

The main different conditions between Examples 1-1 to 1-4 and the test results of Examples 1-1 to 1-4 were shown in the following Table 1.

TABLE 1

| | | Test results | | | |
|---|---|---|---|---|---|
| Example | Reaction temperature | Distribution of the first holes | Depth of the first holes (μm) | Diameter of the first holes (μm) | Percentage of area occupied by the first holes on the surface of the metal part |
| Example 1-1 | 20° C. | communication between the first holes, the holes with barbed-shape are sparse | 50 to 80 | 300 to 500 | 15% |
| Example 1-2 | 30° C. | the holes with barbed-shape are formed in the surface of the stainless steel portion, the holes near the aluminum alloy portion are sparse | 60 to 100 | 50 to 100 | 25% |
| Example 1-3 | 40° C. | the holes with barbed-shape are formed in the surface of the stainless steel portion, the holes near the aluminum alloy portion are sparse | 70 to 120 | 60 to 120 | 30% |

TABLE 1-continued

| Example | Reaction temperature | Test results: Distribution of the first holes | Depth of the first holes (μm) | Diameter of the first holes (μm) | Percentage of area occupied by the first holes on the surface of the metal part |
|---|---|---|---|---|---|
| Example 1-4 | 50° C. | the holes with barbed-shape are formed in the surface of the stainless steel portion, the holes near the aluminum alloy portion are uniform | 80 to 140 | 70 to 130 | 35% |

Figure 5:
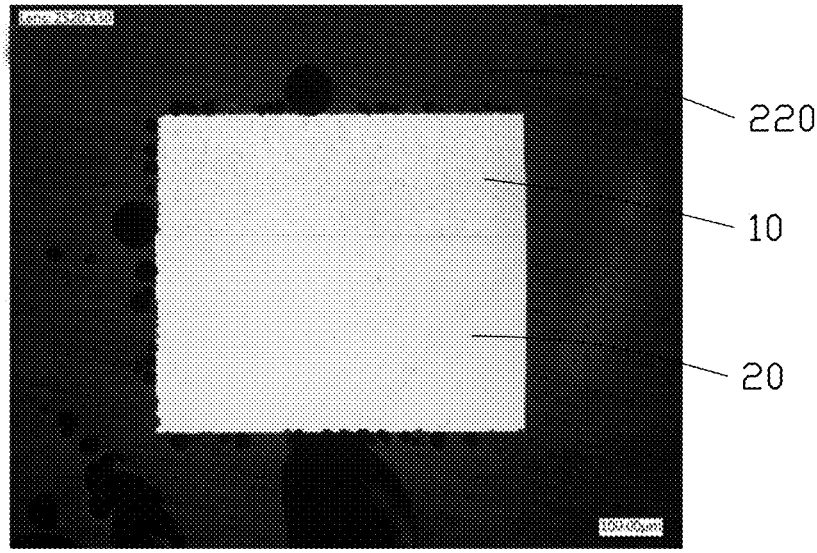
FIG. 5 is an optical microscope image of a metal composite formed by a metal product with first holes of Example 1-2 of the present disclosure after injection molding.
Figure 6:
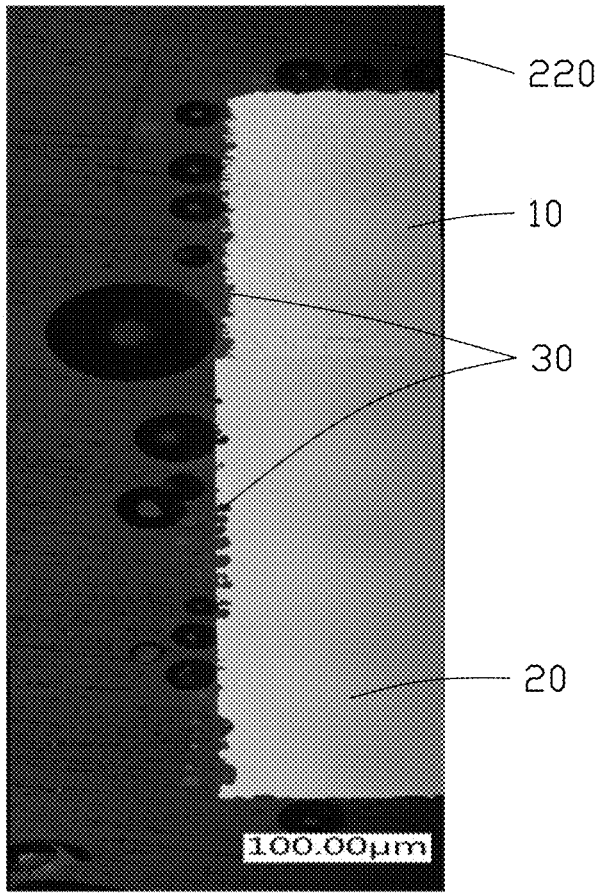
FIG. 6 is a partial enlarged view of the metal composite of FIG. 5.
Figure 7:
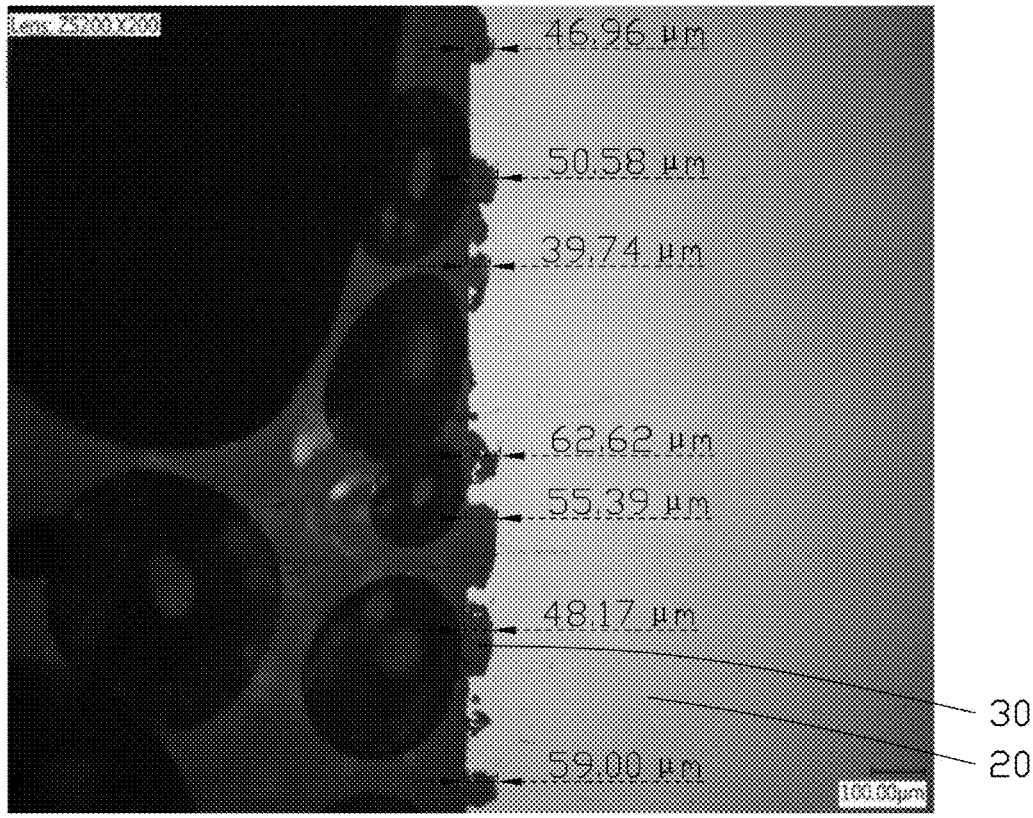
FIG. 7 is a partial enlarged view of a stainless steel portion of the metal composite of FIG. 5.
Figure 8:
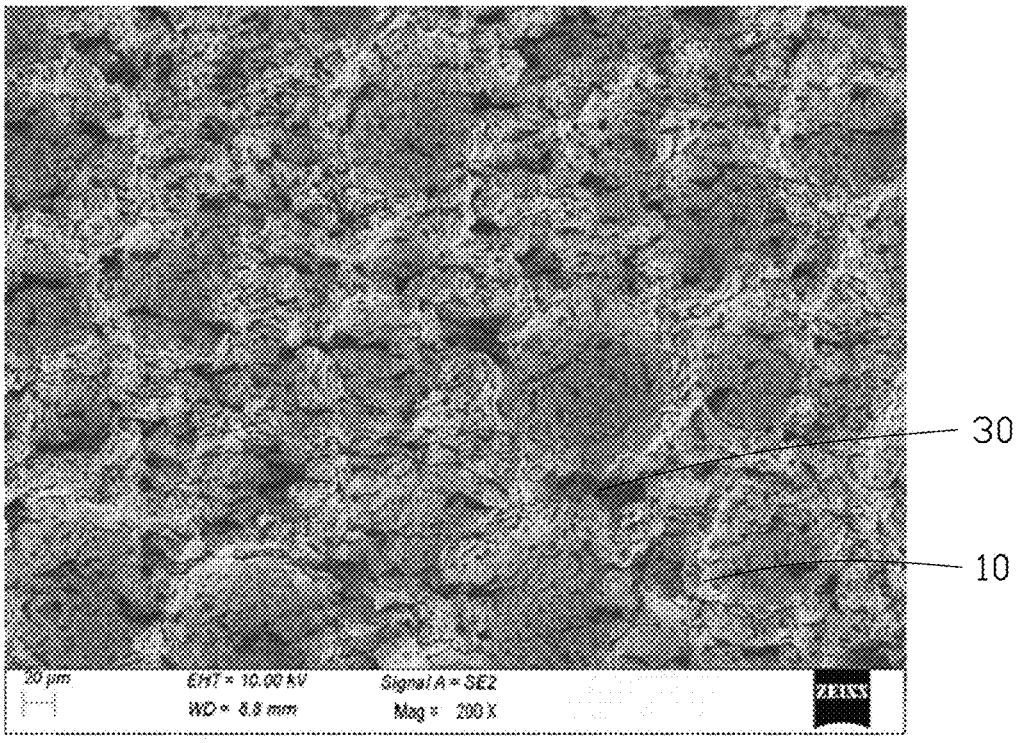
FIG. 8 is a scanning electron microscope (SEM) image of an aluminum alloy portion of an aluminum alloy-stainless steel metal product with second holes of Example 1-2 of the present disclosure.
Figure 9:
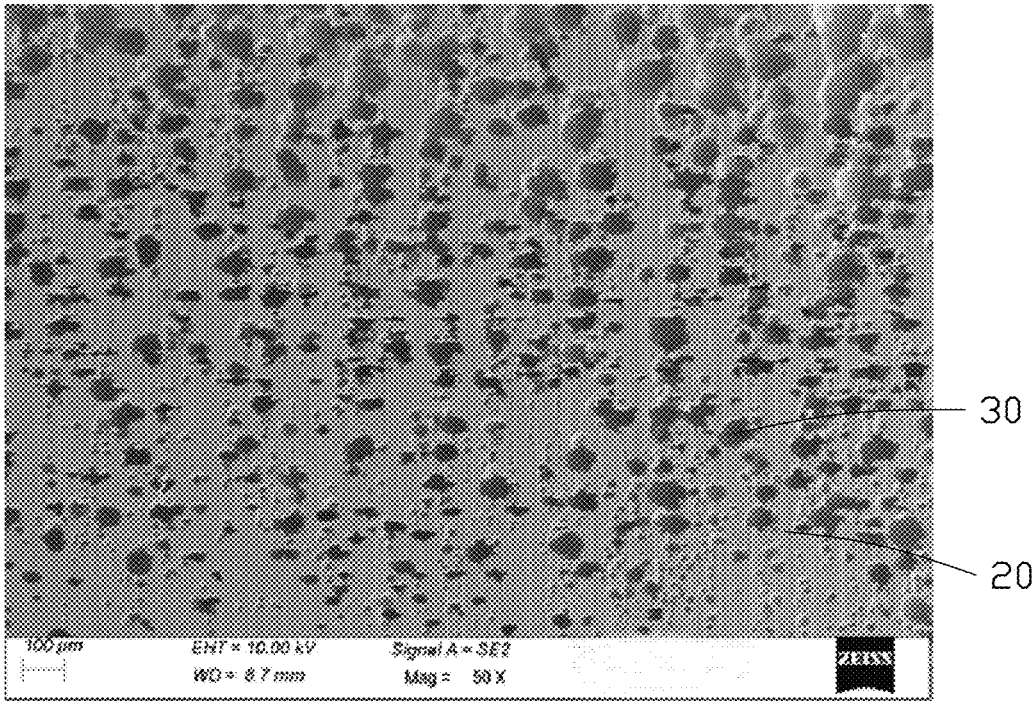
FIG. 9 is a SEM image of a stainless steel portion of an aluminum alloy-stainless steel metal product with second holes of Example 1-2 of the present disclosure.
Figure 10:
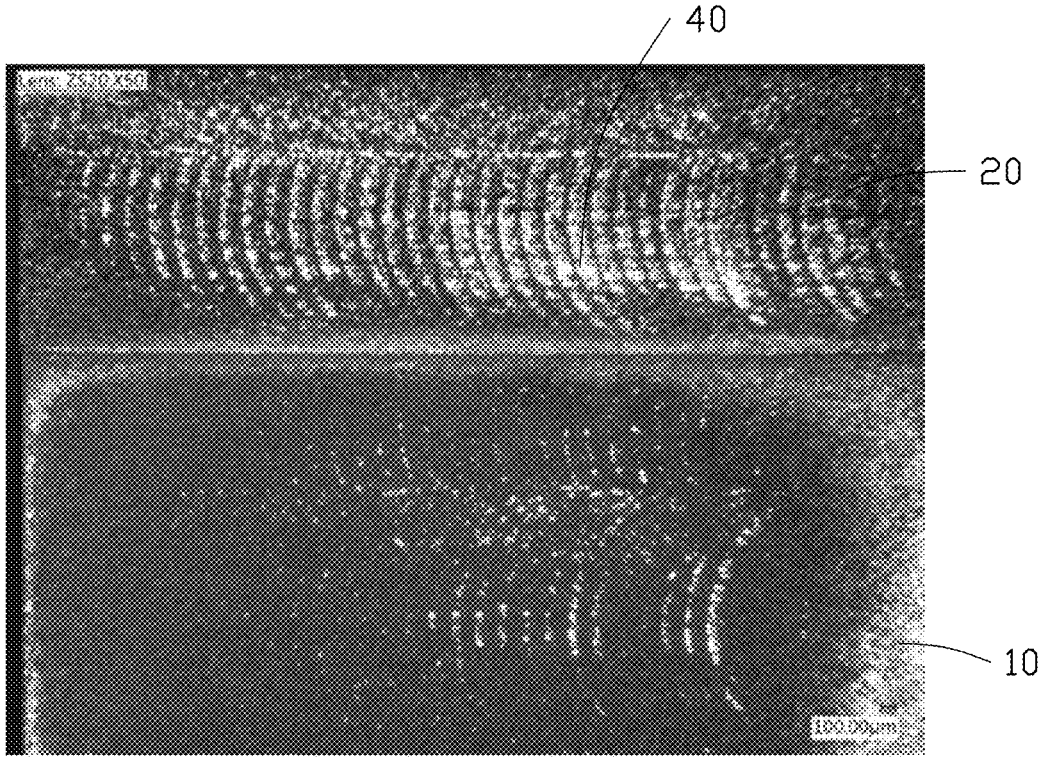
FIG. 10 is an optical microscope image of an aluminum alloy-stainless steel metal product with second holes of Example 5-1 of the present disclosure.

FIGS. 5, 6 and 7 are tested optical microscope images of the metal composite 200 formed by injection molding the aluminum alloy-stainless steel metal product 80 obtained after the method for forming holes of Example 1-2 of the present disclosure. The first holes 30 are formed in both of the surface of the aluminum alloy portion 10 and the surface of the stainless steel portion 20. The material product 220 surrounds the metal product 80 and is formed in the first holes 30. The diameter and the depth of the first holes 30 can be measured from FIG. 7. The measured depths of some of the first holes 30 are, for example, 46.96 μm, 50.58 μm, 39.74 μm, 62.62 μm, 55.39 μm, 48.17 μm, and 59.00 μm. It should be noted that FIG. 7 is only a structure of part of the first holes 30 in the aluminum alloy-stainless steel metal product 80, and the range of the depth of the first holes 30 of Example 1-2 is the range of an average depth of all the first holes 30 in the the aluminum alloy-stainless steel metal product 80. Referring to FIG. 8, coral-shaped first holes 30 are formed in the surface of the aluminum alloy portion 10. Referring to FIG. 9, pitting-shaped first holes 30 are formed in the surface of the stainless steel portion 20.

It can be seen form the test results in Table 1: in Examples 1-1 to 1-4, the first holes 30 can be formed both in the surface of the aluminum alloy portion 10 and the surface of the stainless steel portion 20. As the reaction temperature increases, the depth of the first holes 30 and the percentage of area occupied by the first holes 30 both are increased. The main reason is that as the reaction temperature increases, the corrosion activity of Cl increases, which leads to an increase in the depth of the first holes and the percentage of area occupied by the first holes. It can be seen from the test results of Example 1-1 and Example 1-2 that since a crystallization temperature of phosphoric acid is 21° C., a viscosity of phosphoric acid increases at a temperature (such as 20° C.) lower than the crystallization temperature. During the reaction process, phosphoric acid will adhere to the newly formed first holes 30, so that Cl cannot contact the inner wall of each of the newly formed first holes 30 to deepen the first holes 30, and Cl will corrode the metal at the edge of each of the first holes 30 to causing a communication between the first holes. As a result, the diameter of the first holes increase but the depth of the first holes is relatively small.

Examples 2-1 to 2-5

The metal part 100 after the surface treatment was putted into a second solution. The second solution included 1 L propylene glycol as a solvent. The second solutions of Examples 2-1 to 2-5 respectively further included $FeCl_3 \cdot 6H_2O$ with a concentration of 50 g/L, 75 g/L, 100 g/L, 150 g/L, and 200 g/L. A temperature of the second solution was 55° C. Then, the metal part 100 was used as an anode and graphite was used as a cathode, a second voltage of 80V was applied on the metal part 100 for 10 min to form second holes 40. Finally, the metal part 100 with the second holes 40 was cleaned and dried at a temperature of 80° C. to obtain the metal product 80 with the second holes 40.

Comparative Example 2-1

Different from the above Example 2-1, water was used as the solvent.

The main different conditions between Examples 2-1 to 2-5 and Comparative Example 2-1, and the test results of Examples 2-1 to 2-5 and Comparative Example 2-1 were shown in the following Table 2.

TABLE 2

| Example or Comparative Example | Solvent | Concentration of $FeCl_3 \cdot 6H_2O$ (g/L) | Test results: Distribution of the second holes | Depth of the second holes (μm) | Percentage of area occupied by the second holes on the surface of the metal part |
|---|---|---|---|---|---|
| Example 2-1 | propylene glycol | 50 | Relatively uniform | 5-10 | 45% |
| Example 2-2 | propylene glycol | 75 | Relatively uniform | 10-20 | 60% |

TABLE 2-continued

| Example or Comparative Example | Solvent | Concentration of $FeCl_3 \cdot 6H_2O$ (g/L) | Test results: Distribution of the second holes | Test results: Depth of the second holes (μm) | Test results: Percentage of area occupied by the second holes on the surface of the metal part |
|---|---|---|---|---|---|
| Example 2-3 | propylene glycol | 100 | Relatively uniform | 15-30 | 70% |
| Example 2-4 | propylene glycol | 150 | Relatively uniform, the area where holes communicate with each other occupies 5% | 15-35 | 75% |
| Example 2-5 | propylene glycol | 200 | Relatively uniform, the area where holes communicate with each other occupies 20% | 20-40 | 80% |
| Comparative Example 2-1 | water | 50 | No holes, the aluminum alloy portion is corroded a lot | — | — |

It can be seen form the test results in Table 2: the solvent in Comparative Example 2-1 is all water. After a same method for forming holes applied in Example 2-1 to 2-5, the aluminum alloy portion 10 of Comparative Example 2-1 is largely corroded, and no holes can be formed in the stainless steel portion 20 of Comparative Example 2-1. Relatively uniform second holes 40 are respectively formed in the metal part 100 of Examples 2-1 to 2-5, and the second holes 40 are mainly distributed in the stainless steel portion 20 of Examples 2-1 to 2-5. The reason for the above results is: when in an aqueous solution, an activity of the aluminum alloy portion 10 is higher than an activity of the stainless steel portion 20, if an voltage is applied, the aluminum alloy portion 10 is preferentially corroded by ions, and uniform holes cannot be formed in the surface of the stainless steel portion 20; when in an organic solution, the organic solvent increased an energy required for ion migration, and the effective ions that corrode to form holes are evenly bound on the surface of the metal part 100, and the surface of the metal part 100 is weakly corroded by electrochemical traction. If an voltage is applied, an oxide film (alumina) is formed on the surface of the aluminum alloy portion 10 to protect the aluminum alloy portion 10. When the voltage is continuously applied subsequently, the ions cannot continue to react with the aluminum alloy portion 10 coated by the oxide film, and the ions react with the stainless steel portion 20 to form evenly distributed second holes 40 in the surface of the stainless steel. It can be seen from Examples 2-1 to 2-5 that as the mass fraction of $FeCl_3 \cdot 6H_2O$ changes, the distribution and the depth of the second holes 40 and the percentage of area occupied by the second holes 40 are affected, and the percentage of area occupied by the second holes 40 can be increased as the mass fraction of $FeCl_3 \cdot 6H_2O$ increases.

Examples 3-1 to 3-4

The metal part 100 was putted into a second solution. The second solution included 1 L propylene glycol. The second solutions of Examples 3-1 to 3-4 respectively further included different salts that can dissociate Cl with a concentration of 300 mmol/L. A temperature of the second solution was 65° C. Then, the metal part 100 was used as an anode, a second voltage of 80V was applied on the metal part 100 for 8 min to form second holes 40. Finally, the metal part 100 with the second holes 40 was cleaned and dried to obtain the metal product 80 with the second holes 40.

The main different conditions between Examples 3-1 to 3-4 and the test results of Examples 3-1 to 3-4 were shown in the following Table 3.

TABLE 3

| Example | Second solution | Test results: Distribution of the second holes | Test results: Depth of the second holes (μm) | Test results: Percentage of area occupied by the second holes on the surface of the metal part |
|---|---|---|---|---|
| Example 3-1 | 300 mmol/L NaCl | uniform, part of the area where holes communicate with each other | 2-8 | 15% |
| Example 3-2 | 150 mmol/L $CuCl_2 \cdot 12H_2O$ | uniform | 20-50 | 10% |

TABLE 3-continued

| Example | Second solution | Test results: Distribution of the second holes | Depth of the second holes (μm) | Percentage of area occupied by the second holes on the surface of the metal part |
|---|---|---|---|---|
| Example 3-3 | 100 mmol/L $FeCl_3 \cdot 6H_2O$ | uniform | 5-20 | 55% |
| Example 3-4 | 50 mmol/L $FeCl_3 \cdot 6H_2O$ and 150 mmol/L NaCl | uniform | 15-30 | 75% |

Figure 11:
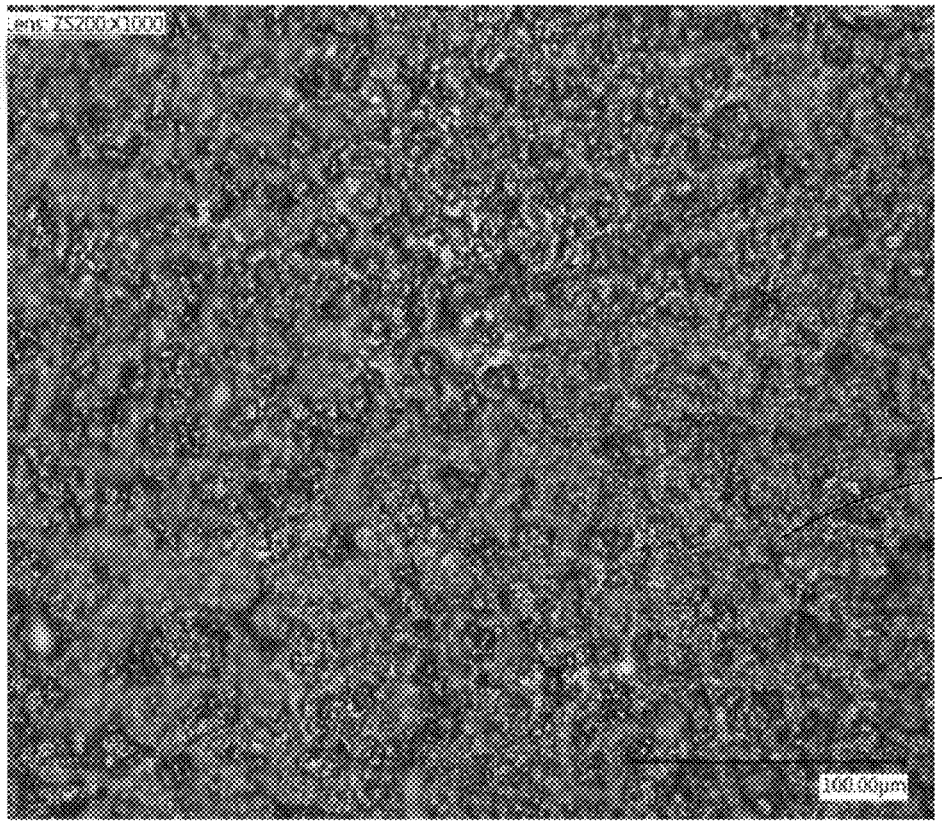
FIG. 11 is a partial enlarged view of an aluminum alloy portion of FIG. 10.
Figure 12:
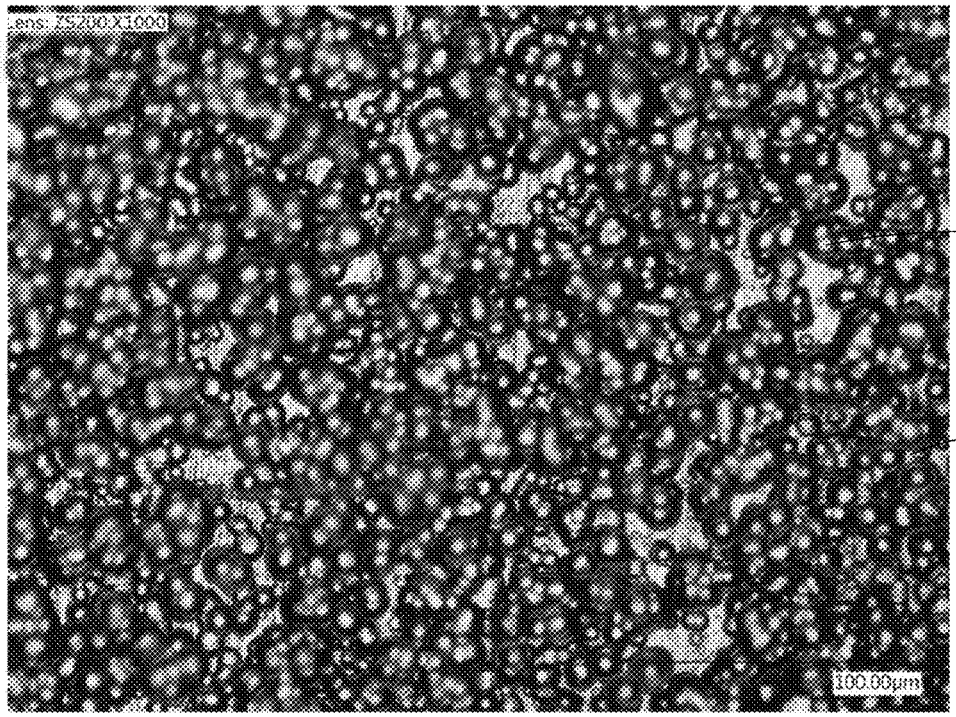
FIG. 12 is a partial enlarged view of a stainless steel portion of FIG. 10.

FIGS. 10, 11, 12 and 13 are tested optical microscope images of the metal product 80 of Example 3-1. Referring to FIG. 11, the surface of the aluminum alloy portion 10 is basically not corroded. Referring to FIG. 12, high-density and unform second holes 40 are formed in the surface of the stainless steel portion 20.

Figure 13:
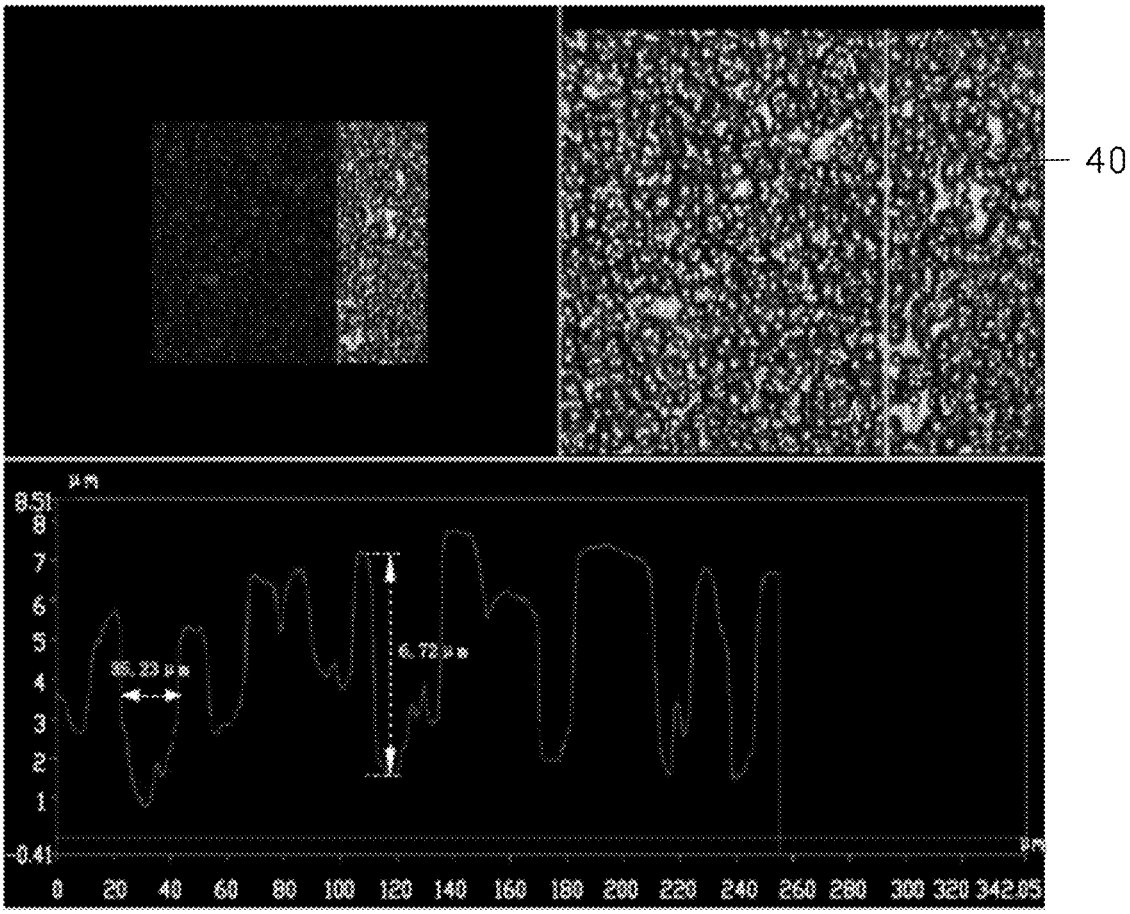
FIG. 13 is a partial enlarged view of the stainless steel portion of FIG. 12 and an test view of a diameter and a depth of a hole along A-A.

The diameter and the depth of the second holes 40 in the stainless steel portion 20 are measured from FIG. 13. The diameter of one of the second holes 40 is 35.23 μm, the depth of one of the second holes 40 is 6.72 μm. The approximate range of the diameter and the approximate range of the depth of the second holes 40 can be calculated from FIG. 13.

It can be seen form the test results in Table 3: the evenly distributed second holes 40 can be formed in the surface of the stainless steel portion 20 by different kinds of chlorides. When sodium chloride (Example 3-1) is used as a source of corrosive ions ($Cl^-$), the diameter and the depth of the second holes 40 in the surface of the stainless steel portion 20 are both small, and the communication between the second holes 40 is easy to occur. In Example 3-2 to 3-4, in addition to $Cl^-$, the corrosive ions further includes $Fe^{3+}$ or $Cu^{2+}$, and $Fe^{3+}$ or $Cu^{2+}$ reacts with elemental iron during applying the voltage to form the second holes 40 with larger diameter and larger depth. Wherein, the depth of the second holes of Example 3-2 is significantly greater than the depth of the second holes of Example 3-3.

Examples 4-1 to 4-5

The metal part 100 was putted into a second solution. The second solution of Examples 4-1 to 4-5 respectively included different organic solvents with a mass fraction of 95%. The second solution further included 5 wt % $FeCl_3 \cdot 6H_2O$. A temperature of the second solution was 50° C. Then, the metal part 100 was used as an anode, a second voltage of 70V was applied on the metal part 100 for 5 min to form second holes 40. Finally, the metal part 100 with the second holes 40 was cleaned and dried to obtain the metal product 80 with the second holes 40.

The main different conditions between Examples 4-1 to 4-5 and the test results of Examples 4-1 to 4-5 were shown in the following Table 4.

TABLE 4

| Example | Organic solvent | mass fraction | Test results Percentage of area occupied by the second holes on the surface of the metal part |
|---|---|---|---|
| Example 4-1 | propylene glycol | 95% | 50% |
| Example 4-2 | ethylene glycol | 95% | 28% |
| Example 4-3 | diethylene glycol | 95% | 25% |
| Example 4-4 | glycerol | 95% | 50% |
| Example 4-5 | propylene glycol and ethylene glycol | 50% and 45% | 55% |

It can be seen form the test results in Table 4: the evenly distributed second holes 40 can be formed in the surface of the stainless steel portion 20 by different kinds of alcohols as organic solvents. Different alcohols have an influence on the percentage of area occupied by the second holes 40, but no aluminum alloy portions 10 are corroded by the different alcohols.

Examples 5-1 to 5-4

The metal part 100 was putted into a second solution. The second solution included 95 wt % propylene glycol and 5 wt % $FeCl_3 \cdot 6H_2O$. A temperature of the second solution was 60° C. Then, the metal part 100 was used as an anode, second voltage of 20V. 60V, 80V, and 100V were respectively applied on the metal parts 100 of Examples 5-1 to 5-4 for 15 min to form second holes 40. Finally, the metal part 100 with the second holes 40 was cleaned and dried to obtain the metal product 80 with the second holes 40.

The main different conditions between Examples 5-1 to 5-4 and the test results of Examples 5-1 to 5-4 were shown in the following Table 5.

TABLE 5

| Example | Second voltage (V) | Test results: Distribution of the second holes | Percentage of area occupied by the second holes on the surface of the metal part |
|---|---|---|---|
| Example 5-1 | 20 | a small number of the second holes appear on the edge of the stainless steel portion | 5% |

TABLE 5-continued

| Example | Second voltage (V) | Test results: Distribution of the second holes | Test results: Percentage of area occupied by the second holes on the surface of the metal part |
|---|---|---|---|
| Example 5-2 | 60 | the second holes appear on the edge of the stainless steel portion | 15% |
| Example 5-3 | 80 | the second holes uniformly appear in the surface of the stainless steel portion | 45% |
| Example 5-4 | 100 | the second holes appear in the surface and on the edge of the stainless steel portion, the second holes on the edge of the stainless steel portion communicate with each other | 10% |

It can be seen form the test results in Table 5: as the second voltage increases, it is beneficial to increase the percentage of area occupied by the second holes. If the second voltage is too high, the edge of the stainless steel portion 20 is easy to excessive corrosion. So that the excessive corrosion can be avoided by reducing the second voltage.

Examples 6-1 to 6-3

The metal part 100 treated in Example 2-1 was putted into a first solution 70 at 35° C. The first solution 70 included 40 wt % propylene glycol, 5 wt % ethylene glycol, 10 wt % phosphoric acid, and 45 wt % water. The first solutions 70 of Examples 6-1 to 6-3 further included sodium chloride with a concentration of 2 g/L, 4 g/L, and 8 g/L, respectively. Then, the metal part 100 was used as an anode, a first voltage was applied on the metal part 100 for 15 min to form first holes 30. A current density of the first voltage was controlled to be 2 A/dm$^2$. Finally, the metal part 100 with the first holes 30 was taken out to wash with water, and dried at a temperature of 80° C. for 20 min.

Comparative Example 6-1

Different from the above Example 6-2, the first solution 70 does not include any organic solvent, and the mass fraction of the water is 90 wt %.

Comparative Example 6-2

Different from the above Example 6-1, the first solution 70 does not include sodium chloride.

The main different conditions between Examples 6-1 to 6-3 and Comparative Examples 6-1 to 6-2, and the test results of Examples 6-1 to 6-3 and Comparative Examples 6-1 to 6-2 were shown in the following Table 6.

TABLE 6

| Example or Comparative Example | Solvent | Concentration of NaCl | Test results: Distribution of the first holes | Test results: Depth of the first holes (μm) | Test results: Diameter of the first holes (μm) | Test results: Percentage of area occupied by the first holes on the surface of the metal part |
|---|---|---|---|---|---|---|
| Example 6-1 | propylene glycol and ethylene glycol | 2 g/L | the holes with barbed-shape is formed in the surface of the stainless steel portion | 20-30 | 20-30 | 10% |
| Example 6-2 | propylene glycol and ethylene glycol | 4 g/L | the holes with barbed-shape is formed in the surface of the stainless steel portion | 30-80 | 30-50 | 20% |
| Example 6-3 | propylene glycol and ethylene glycol | 8 g/L | the holes with barbed-shape is formed in the surface of the stainless steel portion | 50-100 | 60-120 | 30% |
| Comparative Example 6-1 | water | 4 g/L | No hole is formed in the surface of the stainless steel portion, the aluminum alloy portion is excessively corroded | — | — | — |

TABLE 6-continued

| Example or Comparative Example | Solvent | Concentration of NaCl | Test results: Distribution of the first holes | Depth of the first holes (μm) | Diameter of the first holes (μm) | Percentage of area occupied by the first holes on the surface of the metal part |
|---|---|---|---|---|---|---|
| Comparative Example 6-2 | propylene glycol and ethylene glycol | 0 g/L | the surface of the stainless steel portion is polished | — | — | — |

Figure 14:
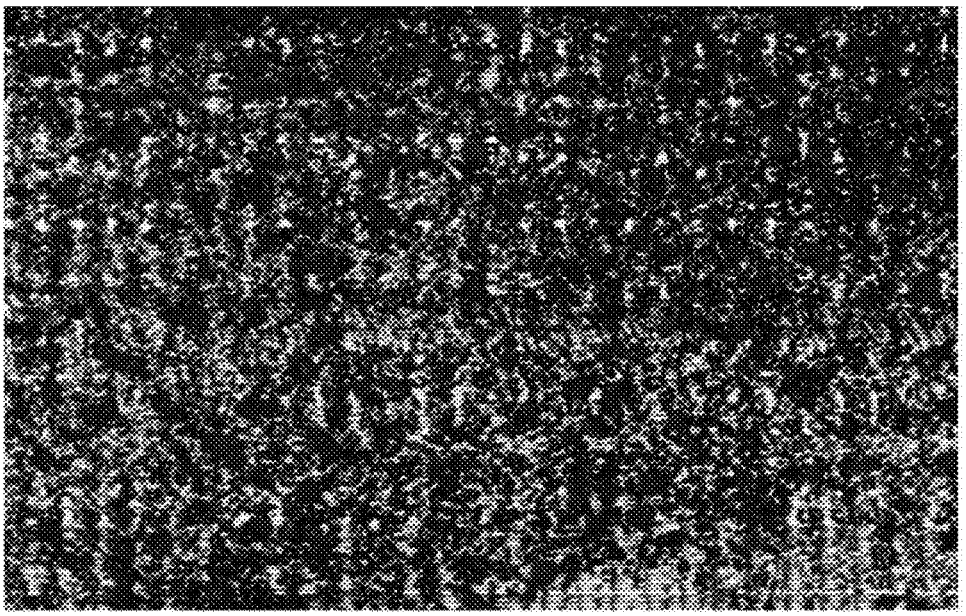
FIG. 14 an optical microscope image of a stainless steel portion with first holes and second holes of a metal product Example 6-3 of the present disclosure.
Figure 15:
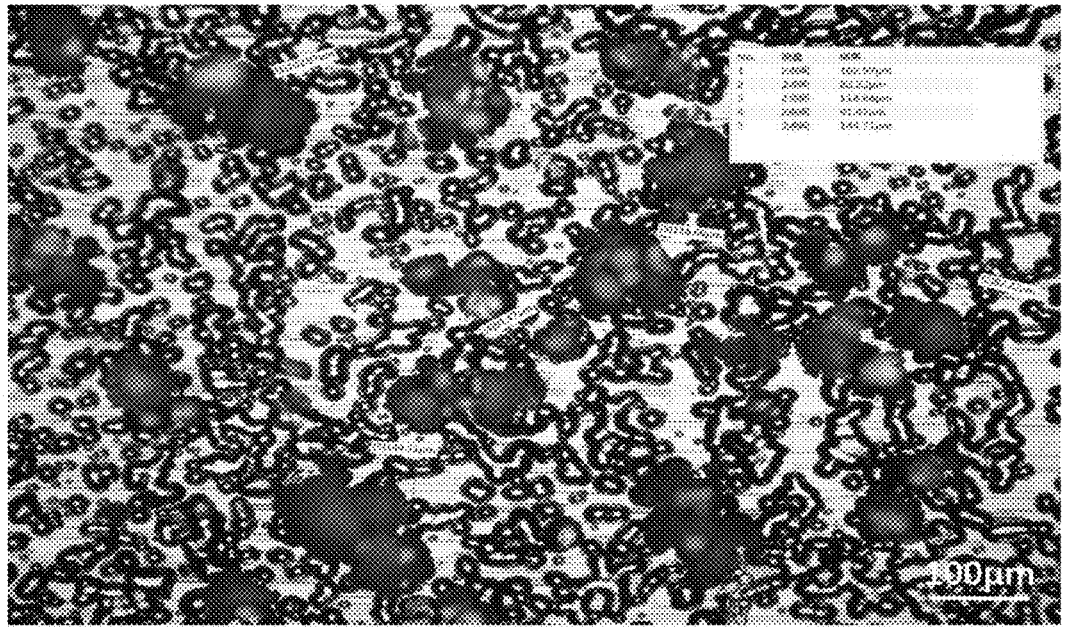
FIG. 15 is a partial enlarged view of the stainless steel portion of FIG. 14.
Figure 16:
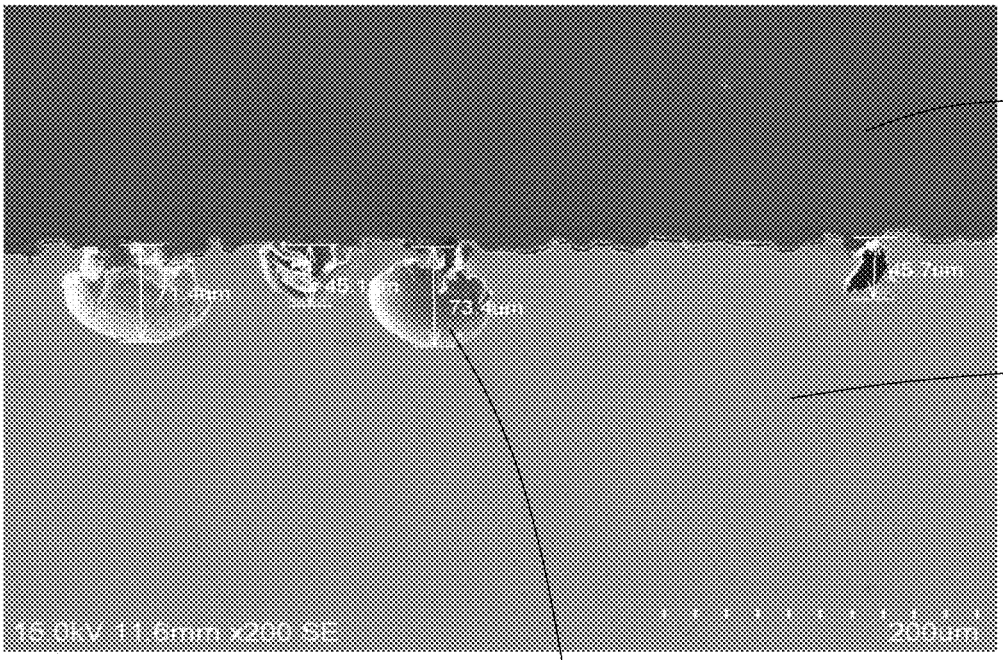
FIG. 16 is a SEM image of a metal composite formed by an aluminum alloy-stainless steel metal product with first holes and second holes of Example 6-3 of the present disclosure after injection molding.
Figure 17:
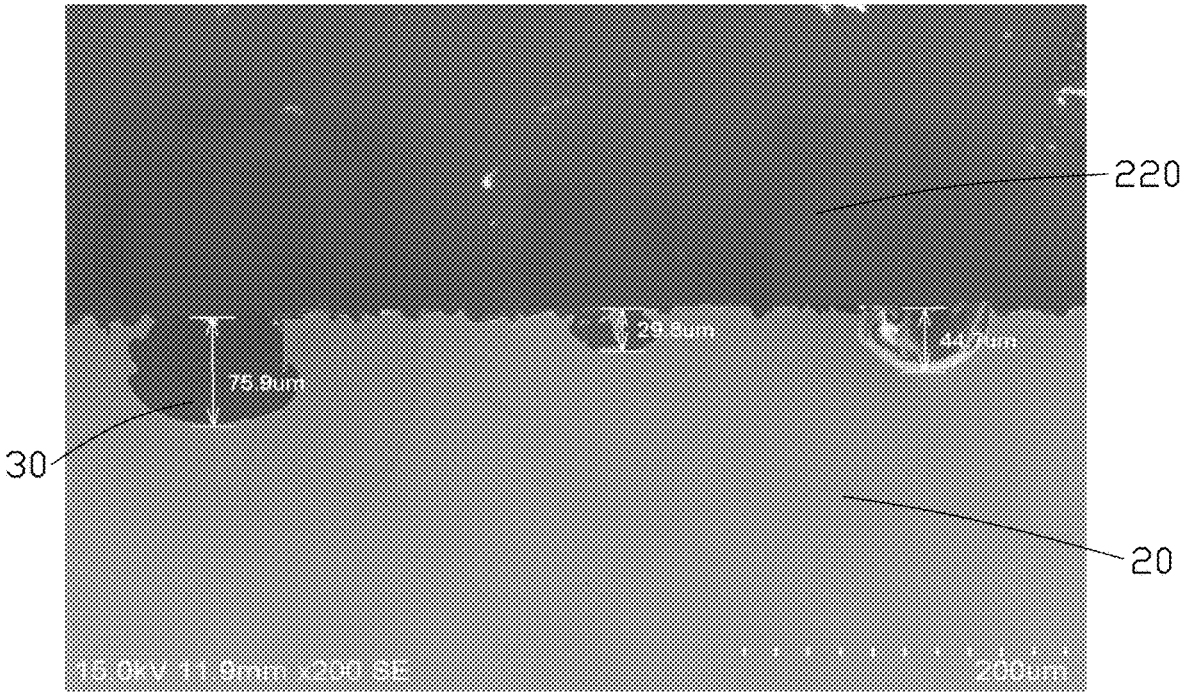
FIG. 17 is a SEM image of a metal composite formed by an aluminum alloy-stainless steel metal product with first holes and second holes of Example 6-3 of the present disclosure after injection molding.

FIGS. 14 and 15 are tested optical microscope images of the stainless steel portion 20 of the metal product 80 of Example 6-3. The diameter and the depth of the first hole 30 can be measured from the enlarged view. FIGS. 16 and 17 are tested optical microscope images of the metal composite 200 formed by injecting material product 220 on the metal product 80. Pitting-shaped first holes 30 and barbed-shaped first holes 30 are formed in the surface of the stainless steel portion 20.

It can be seen form the test results in Table 6: comparing Examples 6-1 to 6-3 and Comparative Example 6-1, the barbed-shaped holes can be formed in the surface of the stainless steel portion 20 of each of Examples 6-1 to 6-3. Due to addition of the organic solvent, the difference in chemical characteristics between the stainless steel portion 20 and the aluminum alloy portion 10 can be balanced. In the aqueous solution system, since a chemical activity of the aluminum alloy portion 10 is higher than a chemical activity of the stainless steel portion 20, the reaction system will mainly chemically corrode the aluminum alloy portion 10, and the surface of the stainless steel portion 20 cannot be corroded.

Comparing Examples 6-1 to 6-3 and Comparative Example 6-2, the barbed-shaped holes can be formed in the surface of the stainless steel portion 20 of each of Examples 6-1 to 6-3, and the surface of the stainless steel portion 20 of Comparative Example 6-2 is polished. The above situation shows that the holes can be formed on the surface of the stainless steel portion 20 by Cl. Comparing Examples 6-1 to 6-3, as a concentration of Cl increases, a hole-forming ability, the diameter of the holes, and the depth of the holes increase. When the concentration of sodium chloride is higher than 8 g/L, the diameter of the first holes 30 and the depth of the first holes 30 will no longer change significantly.

Examples 7-1 to 7-3

The metal part 100 treated in Example 2-1 was putted into a first solution 70 at 30° C. The first solution 70 included 40 wt % propylene glycol, 5 wt % ethylene glycol, 10 wt % phosphoric acid, and 45 wt % water. The first solutions 70 of Examples 7-1 to 7-3 further included 200 mmol/L potassium chloride, 66.7 mmol/L ferric chloride, and 100 mmol/L copper chloride, respectively. Then, the metal part 100 was used as an anode, a first voltage was applied on the metal part 100 for 5 min to form first holes 30. A current density of the first voltage was controlled to be 4 A/dm$^2$. Finally, the metal part 100 with the first holes 30 was taken out to wash with water, and dried at a temperature of 80° C. for 20 min.

The main different conditions between Examples 7-1 to 7-3, and the test results of Examples 7-1 to 7-3 were shown in the following Table 7.

TABLE 7

| Example | Chloride | Test results: Distribution of the first holes | Depth of the first holes (μm) | Diameter of the first holes (μm) | Percentage of area occupied by the first holes on the surface of the metal part |
|---|---|---|---|---|---|
| Example 7-1 | 200 mmol/L potassium chloride | the holes with barbed-shape are formed in the surface of the stainless steel portion | 50-100 | 60-120 | 15% |
| Example 7-2 | 66.7 mmol/L ferric chloride | the holes with barbed-shape are formed in the surface of the stainless steel portion | 20-30 | 30-60 | 10% |
| Example 7-3 | 100 mmol/L copper chloride | the holes with barbed-shape are formed in the surface of the stainless steel portion | 25-35 | 60-120 | 8% |

It can be seen form the test results in Table 7: the depth of the holes is relatively reduced in Examples containing ferric chloride or copper chloride. This is because $Fe^3$ in the ferric chloride and Fe element in the stainless steel part 20 will undergo an oxidation-reduction reaction to form $Fe^{2+}$, $Cu^{2+}$ in the copper chloride will undergo a substitution reaction with the Fe element in the stainless steel part 20 to form elemental copper. The above reaction will be rapid in the early stage of the reaction, so that the diameter and the depth of the holes can be enlarged. However, $Fe^{2+}$ generated by the oxidation-reduction reaction and the elemental copper generated by the substitution reaction will accumulate in the holes, which will affect the further progress of the above reaction, resulting in a relatively low final depth and a relatively low percentage of area occupied by the first holes. Since the stainless steel part 20 contains more Fe element, under the same $Cl^-$ dissociation concentration, the molar concentration of $Cu^{2+}$ will be greater than the molar concentration of $Fe^{3+}$, more $Cu^{2+}$ will undergo substitution reaction with Fe element at the beginning of the etching reaction, and the diameter of the holes etched by the first solution 70 containing copper chloride will be larger than the diameter of the holes etched by the first solution 70 containing ferric chloride, and has no negative effect on the aluminum alloy portion 10.

Examples 8-1 to 8-3 and Comparative Example 8-1

The metal part 100 treated in Example 2-1 was putted into a first solution 70 at 45° C. The first solution 70 included 40 wt % propylene glycol, 5 wt % ethylene glycol, 5 wt % sodium chloride, and 45 wt % water. The first solutions 70 of Examples 8-1 to 8-3 and Comparative Example 8-1 further included phosphoric acid with a concentration of 50 g/L, 100 g/L, 200 g/L, and 0 g/L, respectively. Then, the metal part 100 was used as an anode, a first voltage was applied on the metal part 100 for 10 min to form first holes 30. A current density was controlled to be 6 A/dm$^2$. Finally, the metal part 100 with the first holes 30 was taken out to wash with water, and dried at a temperature of 80° C. for 20 min.

The main different conditions between Examples 8-1 to 8-3 and Comparative Example 8-1, and the test results of Examples 8-1 to 8-3 and Comparative Example 8-1 were shown in the following Table 8.

TABLE 8

| | | Test results | | | |
|---|---|---|---|---|---|
| Example or Comparative Example | Concentration of phosphoric acid | Distribution of the first holes | Depth of the first holes (μm) | Diameter of the first holes (μm) | Percentage of area occupied by the first holes on the surface of the metal part |
| Example 8-1 | 50 g/L | he holes with barbed-shape are formed in the surface of the stainless steel portion | 20-30 | 20-30 | 10% |
| Example 8-2 | 100 g/L | he holes with barbed-shape are formed in the surface of the stainless steel portion | 50-100 | 60-120 | 35% |
| Example 8-3 | 200 g/L | the holes with barbed-shape are formed in the surface of the stainless steel portion, part of the area where holes communicate with each other | 60-100 | 150-300 | 15% |
| Comparative Example 8-1 | 0 g/L | The holes are spherical | 5-10 | 10-30 | 25% |

It can be seen form the test results in Table 8: a proper amount of phosphoric acid can increase the percentage of area occupied by the barbed-shaped holes, but an excessively high content of phosphoric acid will cause electrochemical polishing on the surface of the stainless steel part 20, and the barbed-shaped holes cannot be formed without phosphoric acid.

Examples 9-1 to 9-3

The metal part 100 treated in Example 2-1 was putted into a first solution 70 at 25° C. The first solution 70 included 40 wt % propylene glycol, 5 wt % ethylene glycol, 5 wt % sodium chloride, 45 wt % water, and 5 g/L phosphoric acid. Then, the metal part 100 was used as an anode, a first voltage was applied on the metal part 100 for 12 min to form first holes 30. Current densities of Examples 9-1 to 9-3 were controlled to be 2 A/dm$^2$, 5 A/dm$^2$, and 8 A/dm$^2$. Finally, the metal part 100 with the first holes 30 was taken out to wash with water, and dried at a temperature of 80° C. for 20 min.

The main different conditions between Examples 9-1 to 9-3, and the test results of Examples 9-1 to 9-3 were shown in the following Table 9.

TABLE 9

| Example | Current density ($A/dm^2$) | Test results: Distribution of the first holes | Depth of the first holes (μm) | Diameter of the first holes (μm) | Percentage of area occupied by the first holes on the surface of the metal part |
|---|---|---|---|---|---|
| Example 9-1 | 2 | the holes with barbed-shape are formed in the surface of the stainless steel portion | 40-80 | 40-80 | 25% |
| Example 9-2 | 5 | the holes with barbed-shape are formed in the surface of the stainless steel portion | 60-100 | 50-120 | 35% |
| Example 9-3 | 8 | the holes with barbed-shape are formed in the surface of the stainless steel portion, part of the area where holes communicate with each other | 70-110 | 100-300 | 25% |

It can be seen form the test results in Table 8: the barbed-shaped holes can be formed in the surface of the metal composite under a proper current density. If the current density is too low, structures of the holes cannot be formed, and if the current density is too high, it is easy to electrochemically polish the stainless steel part 20, thereby causing the communication between the holes.

In the method for forming holes, by adding corrosive ions into the first solution 70 mainly composed of at least one organic solvent, the organic solvent can increase the energy required for the migration of corrosive ions ($Cl^-$) and reduce the diffusion rate of the corrosive ions (such as $Cl^-$), so that the corrosive ions (such as $Cl^-$) will not be unevenly distributed due to the influence of reaction activity, but can evenly bind effective ions that corrode to form holes on the surface of the metal part 100. Based on the small radius and the strong penetrating ability of $Cl^-$, $Cl^-$ can be preferentially adsorbed on the oxides to squeeze out oxygen atoms of the oxides and combine with cations of the oxides to form soluble chloride, thereby forming the first holes 30 in the surface of the metal part 100. In addition, $PO_4^{3-}$ can react with the metal to form the aluminum phosphate film, thereby forming the first holes 30 in a shape of coral.

It is to be understood, even though information and advantages of the present embodiments have been set forth in the foregoing description, together with details of the structures and functions of the present embodiments, the disclosure is illustrative only; changes may be made in detail, especially in matters of shape, size, and arrangement of parts within the principles of the present embodiments to the full extent indicated by the plain meaning of the terms in which the appended claims are expressed.

What is claimed is:

1. A method for forming holes to form holes in a surface of a metal part, comprising:

putting the metal part into a first solution as an anode;

applying a first voltage on the metal part to form the first holes in a surface of the metal part; and cleaning and drying the metal part with the first holes;

wherein the first solution comprises a first organic solvent, chloride, and a phosphoric acid compound;

wherein before putting the metal part into the first solution, further comprising:

putting the metal part into a second solution as an anode; and applying a second voltage on the metal part to form second holes in a surface of the metal part;

wherein the second solution comprises a second organic solvent and a substance capable of dissociating a compound including $Cl^-$;

wherein the second voltage is output by DC power supply, the second voltage is in a range of 60V to 100V, and a current density is in a range of 1 $A/dm^2$ to 3 $A/dm^2$; in the step of applying the second voltage on the metal part, a temperature of the second solution is in a range of 50° C. to 70° C., and a time of applying the second voltage is in a range of 5 min to 20 min.

2. The method for forming holes of claim 1, wherein the first organic solvent is selected from a group consisting of ethylene glycol, propylene glycol, diethylene glycol, glycerol, and any combination thereof.

3. The method for forming holes of claim 1, wherein chloride is selected from a group consisting of sodium chloride, potassium chloride, copper chloride, ferric chloride, and any combination thereof.

4. The method for forming holes of claim 1, wherein the phosphoric acid compound is selected from a group consisting of phosphoric acid, dihydrogen phosphate, monohydrogen phosphate, phosphate, metaphosphate, and any combination thereof.

5. The method for forming holes of claim 1, wherein the first voltage is output by a gradual DC power supply, an increase rate of the first voltage is in a range of 1 V/s to 2 V/s, and a current density is in a range of 1 $A/dm^2$ to 10 $A/dm^2$; in the step of applying the first voltage on the metal part, a temperature of the first solution is in a range of 25° C. to 55° C., and a time of applying the first voltage is in a range of 10 min to 25 min.

6. The method for forming holes of claim 1, wherein the substance capable of dissociating a compound including $Cl^-$ comprises a compound containing crystallization water.

7. The method for forming holes of claim 1, wherein the substance capable of dissociating a compound including $Cl^-$ is selected from a group consisting of NaCl, KCl, $FeCl_3.6H_2O$, $FeCl_3$, $CuCl_2.12H_2O$, $CuCl_2$, and any combination thereof.

8. The method for forming holes of claim 1, wherein the second solution further comprises a substance capable of dissociating a compound including at least one of $Fe^{3+}$ and $Cu^{2+}$.

9. The method for forming holes of claim 8, wherein the substance capable of dissociating a compound including $Fe^{3+}$ and $Cu^{2+}$ comprises a compound containing crystallization water.

10. The method for forming holes of claim 8, wherein the substance capable of dissociating a compound including $Fe^{3+}$ is selected from a group consisting of $FeCl_3.6H_2O$, $FeCl_3$, and any combination thereof, and the substance capable of dissociating $Cu^{2+}$ is selected from a group consisting of $CuCl_2.12H_2O$, $CuCl_2$, and any combination thereof.

11. The method for forming holes of claim 1, wherein after putting the metal part into the first solution, further comprising:

putting the metal part with the first holes into an electrolyte as an anode; and applying a third voltage on the metal part to form third holes in the metal part;

wherein the metal part is made of a material selected from a group consisting of aluminum, aluminum alloy, a composite material of aluminum alloy and stainless steel, and any combination thereof, the third holes are located in a portion of the metal part containing aluminum or aluminum alloy.

12. The method for forming holes of claim 1, wherein the metal part is made of a material selected from a group consisting of aluminum, aluminum alloy, stainless steel, and any combination thereof.

* * * * *